US008063832B1

(12) United States Patent
Weller et al.

(10) Patent No.: US 8,063,832 B1
(45) Date of Patent: Nov. 22, 2011

(54) DUAL-FEED SERIES MICROSTRIP PATCH ARRAY

(75) Inventors: Thomas Weller, Lutz, FL (US); Bojana Zivanovic, Tampa, FL (US)

(73) Assignee: University of South Florida, Tampa, FL (US)

( * ) Notice: Subject to any disclaimer, the term of this patent is extended or adjusted under 35 U.S.C. 154(b) by 393 days.

(21) Appl. No.: 12/423,494

(22) Filed: Apr. 14, 2009

Related U.S. Application Data

(60) Provisional application No. 61/044,646, filed on Apr. 14, 2008.

(51) Int. Cl.
*H01Q 1/38* (2006.01)

(52) U.S. Cl. ..... 343/700 MS; 343/824

(58) Field of Classification Search ..... 343/700 MS, 343/824, 825, 826, 827
See application file for complete search history.

(56) References Cited

U.S. PATENT DOCUMENTS

| | | | | |
|---|---|---|---|---|
| 5,572,222 | A | 11/1996 | Mailandt et al. | |
| 5,896,107 | A * | 4/1999 | Huynh | 343/700 MS |
| 5,923,296 | A | 7/1999 | Sanzgiri et al. | |
| 6,377,217 | B1 * | 4/2002 | Zhu et al. | 343/700 MS |
| 6,509,874 | B1 * | 1/2003 | Kolak et al. | 343/700 MS |
| 6,906,668 | B2 * | 6/2005 | Rawnick et al. | 343/700 MS |
| 7,589,676 | B2 * | 9/2009 | Popugaev et al. | 343/700 MS |

OTHER PUBLICATIONS

Pozar, D.M. 1989. Analysis of an Infinite Phased Array of Aperture Coupled Microstrip Patches. IEEE Transactions on Antennas and Propagation. vol. 37; No. 4; pp. 418-425.

Pozar, D.M. 1985. A Microstrip Antenna Aperture-Coupled to a Microstripline. Electronics Letters. vol. 21; No. 2; pp. 49-50.

Targonski, S.D.; Pozar, D.M. 1993. Design of Wideband Circularly Polarized Aperture-Coupled Microstrip Antennas. IEEE Transactions on Antennas and Propagation. vol. 41; No. 2; pp. 214-220.

Wong, K.; Tung, H.; Chiou, T. 2002. Broadband Dual-Polarized Aperture-Coupled Patch Antennas With Modified H-Shaped Coupling Slots. IEEE Transactions on Antennas and Propagation. vol. 50; No. 2; pp. 188-191.

Aloni, E.; Kastner, R. 1994. Analysis of a Dual Circularly Polarized Microstrip Antenna Fed by Crossed Slots. IEEE Transactions on Antennas and Propagation. vol. 42; No. 8; pp. 1053-1058.

Shrivastav, A.K.; DAS, A.; DAS, S.K. 2003. Wide Band Omni Directional Radiating Array for Cylindrical Body. Proceedings of INCEMIC. pp. 359-360.

Pozar, D.M. 1996. A Review of Aperture Coupled Microstrip Antennas: History, Operation, Development, and Applications. University of Massachusetts at Amherst. www.ecs.umass.edu/ece/pozar/aperture.pdf.

* cited by examiner

*Primary Examiner* — Hoang V Nguyen
(74) *Attorney, Agent, or Firm* — Courtney M. Dunn; Smith & Hopen, P.A.

(57) ABSTRACT

A sub-array of slot-coupled microstrip antennas fed using microstrip lines on an opposing substrate. Also provided is an omni-directional antenna comprised of six of the sub-arrays arranged in a hexagonal fashion. The gain of the antenna is ~6 dB with a 3 dB elevation beam width of ~30 degrees. The design provides constant beam angle over frequency, which is important for frequency-hopping applications, and the potential to add beam control to mitigate jamming in different sectors.

31 Claims, 16 Drawing Sheets

Top View

Side View

Top View

Side View

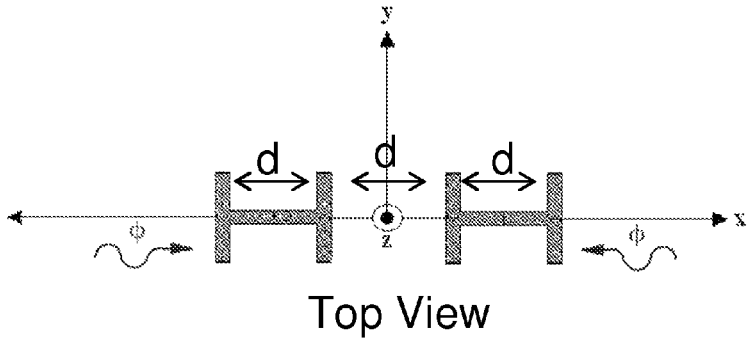
FIG. 18A
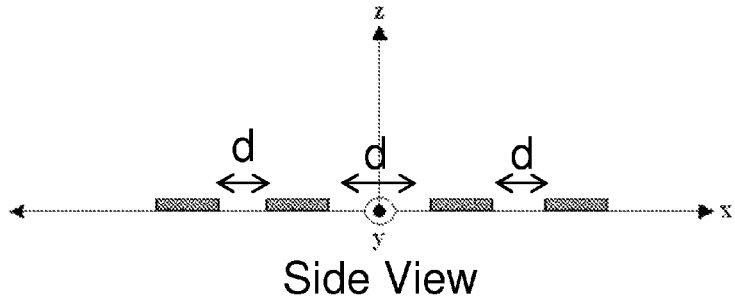
FIG. 18B
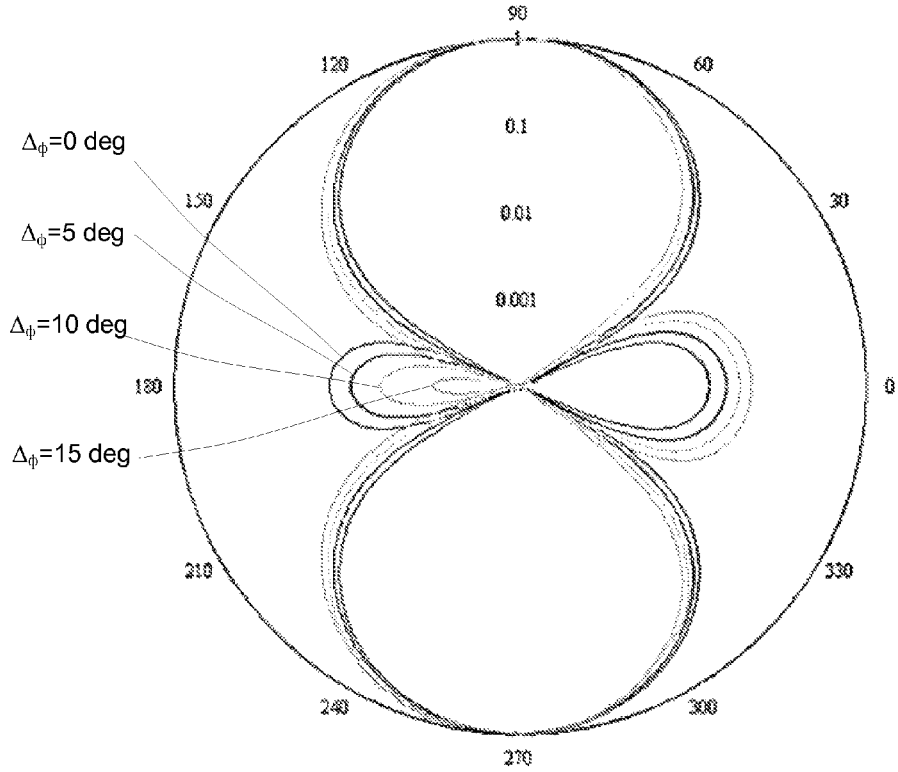

DUAL-FEED SERIES MICROSTRIP PATCH ARRAY

CROSS REFERENCE TO RELATED APPLICATIONS

This application claims priority to currently U.S. Provisional Patent Application No. 61/044,646 filed Apr. 14, 2008.

FIELD OF INVENTION

This invention relates to antennas and more specifically to series-fed aperture-coupled microstrip patch antenna arrays for use in wireless antenna communications.

BACKGROUND

Aperture-coupled microstrip patch antennas are desirable structures for use in wireless telecommunications. Their broad use is primarily due to ease of fabrication, low cost, and simplicity of design. These characteristics, combined with the straightforward integration with microstrip distribution networks, make them especially well suited for phased array applications.

High-gain omni-directional antennas find uses in several communications applications including those for small aerial vehicles. Several topologies for omni-directional radiators exist and include linear arrays using bifilar helical elements, periodic rod antennas, coaxial continuous transverse stub arrays (C-CTS), and patch arrays on a cylindrical body. These approaches typically suffer from beam-pointing variation over frequency, do not offer the capability for beam steering for attitude correction, and do not facilitate advanced beam-reconfiguration options such as eliminating coverage from certain sectors for jamming avoidance.

SUMMARY OF INVENTION

The present invention includes a dual series-fed, four microstrip patch array antenna that utilizes planar design for ease of fabrication and signal routing. The natural tendency of a series-fed array to have beam tilting over frequency is circumvented by using opposing, anti-symmetric balanced feed points. An embodiment uses 180-degree microstrip hybrid couplers to feed pairs of patch elements on each sub-array. This approach makes this element suitable for low-cost frequency-hopped phased array antennas. An approach for inter-element matching to evenly distribute power to each element is also described.

The present invention also includes an omni-directional antenna comprising multiple sub-arrays arranged in a cylindrical or hexagonal configuration. The three-dimensional antenna works over 600 MHz of bandwidth in the C-band with a maximum gain of ~6 dB.

In accordance with the present invention, a microstrip patch antenna array is provided. The antenna comprises two aperture-coupled patch antenna elements positioned in a single row arrangement and a feed line coupled to the two antenna elements such that the two antenna elements are connected in series. The feed line has two open-circuit stubs—the first stub positioned between the two antenna elements and the second stub positioned on the second antenna element. The antenna may further comprise a third and a fourth aperture-coupled patch antenna elements, both positioned in a single row arrangement with the first two antenna elements, and a feed line coupled to the third and fourth antenna elements such that the third and fourth antenna elements are connected in series. The feed line connected to the third and fourth elements also has two open-circuit stubs—the first stub positioned between the two antenna elements and the second stub positioned on the third antenna element. Both feed lines are adapted to receive an input signal. The microstrip patch antenna array may further comprise circuitry for dividing an input signal into two component signals and phase shifting one of the component signals. The circuitry has two outputs, one coupled to each feed line. This circuitry may be a coupler. Alternatively, this circuitry may be a two-way power divider and a phase shifter.

In accordance with the present invention, a multi-directional antenna is provided. The antenna comprises at least two sub-arrays of microstrip patch antennas arranged such that each sub-array forms a single face of a multi-shaped three-dimensional geometric shape. Each of the at least two sub-arrays comprises two pairs of aperture-coupled patch antenna elements in which all four antenna elements are positioned in a single row arrangement. Each pair of antenna elements includes a feed line, which is coupled to each of the antenna elements such that the two elements of the pair are connected in series. Each feed line has two open-circuit stubs, the first stub positioned between the two antenna elements of the pair and the second stub positioned on one of the antenna elements of the pair. The at least two sub-arrays may further comprise splitting and offsetting circuitry for dividing an input signal into two component signals and phase shifting one of the component signals. The splitting and offsetting circuitry has two outputs, one coupled to each feed line. This circuitry may be a coupler. Alternatively, this circuitry may be a two-way power divider and a phase shifter. The antenna may further comprise a multi-way power divider, which is coupled to the coupler, the two-way power divider, or the splitting and offsetting circuitry of each of the sub-arrays. Each antenna element may be comprised of a feed substrate and a patch substrate. Each of the feed substrates faces toward the inside of the hexagonal three-dimensional geometric shape. Each antenna element may further comprise a ground layer positioned in between the feed substrate and the patch substrate, the ground layer being continuous between the sub-arrays. The ground layer may be formed from conductive silver epoxy and copper tape. The antenna may further comprise a reflector positioned within the multi-shaped three-dimensional geometric shape to preserve backside radiation.

In an additional embodiment, the multi-directional antenna comprises a first microstrip patch antenna element with a coupling slot and positioned such that the first antenna element forms a first face of a multi-shaped three-dimensional geometric shape, a first feed line forming an open-circuit stub on the first antenna element, a second microstrip patch antenna element having a coupling slot and positioned such that the second antenna element forms a second face of the multi-shaped three-dimensional geometric shape, and a second feed line forming an open-circuit stub on the second antenna element. The antenna may further comprise a multi-way power divider having a first output coupled to the first feed line and a second output coupled to the second feed line. Each antenna element may be comprised of a feed substrate and a patch substrate, wherein each of the feed substrates faces toward the inside of the hexagonal three-dimensional geometric shape. Each antenna element may further comprise a ground layer positioned in between the feed substrate and the patch substrate, the ground layer being continuous between the sub-arrays. The ground layer may be formed from conductive silver epoxy and copper tape. The antenna may further comprise a reflector positioned within the multi-shaped three-dimensional geometric shape to preserve back-side radiation.

A method for providing symmetrical excitation of a microstrip patch array antenna about a central point in accordance with an embodiment of the present invention includes the step of providing a microstrip patch array antenna. The microstrip patch array antenna comprises two pairs of aperture-coupled patch antenna elements. Each pair of antenna elements includes a feed line, which is coupled to each of the antenna elements such that the two elements of the pair are connected in series. Each feed line has two open-circuit stubs—the first stub positioned between the two antenna elements of the pair and the second stub positioned on one of the antenna elements. The method further comprises applying a first signal to one of the feed lines and applying a second signal to the other feed line, wherein the first signal and the second signal are about 180 degrees out of phase. The provided microstrip patch antenna may further comprise circuitry for dividing an input signal into two component signals and phase shifting one of the component signals to create the two signals that are 180 degrees out of phase. The circuitry has two outputs, one coupled to each feed line for outputting the two component signals. This circuitry may be a coupler. Alternatively, this circuitry may be a two-way power divider and a phase shifter.

BRIEF DESCRIPTION OF THE DRAWINGS

For a fuller understanding of the invention, reference should be made to the following detailed description, taken in connection with the accompanying drawings, in which:

FIG. 18A is a graph showing the top view and side view of the patch elements with equal element spacing and pair spacing and showing the feed phase, $\phi$ in accordance with an embodiment of the present invention.

FIG. 18B is a diagram illustrating the pattern variation for the relative feed phase as shown in FIG. 18A in accordance with an embodiment of the present invention.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The design of a low-cost microstrip patch antenna suitable for frequency-hopped communications is presented. Two of the main considerations were to achieve an instantaneous bandwidth greater than 10% and to minimize the elevation beam-angle variation over frequency. A suitable solution to these requirements is an N×1 microstrip patch array. As shown herein, the use of an aperture-coupled feed along with the proper choice of substrate materials provides sufficient bandwidth and also avoids the need for live vias or their equivalent. A series-fed approach, combined with an anti-symmetric dual excitation from both ends of the array, helps to address the elevation beam-pointing specification and reduces the distribution network complexity. The dual-feed forces excitation symmetry about the center of the array, thereby keeping the elevation beam fixed at broadside independent of frequency.

Figure 1:
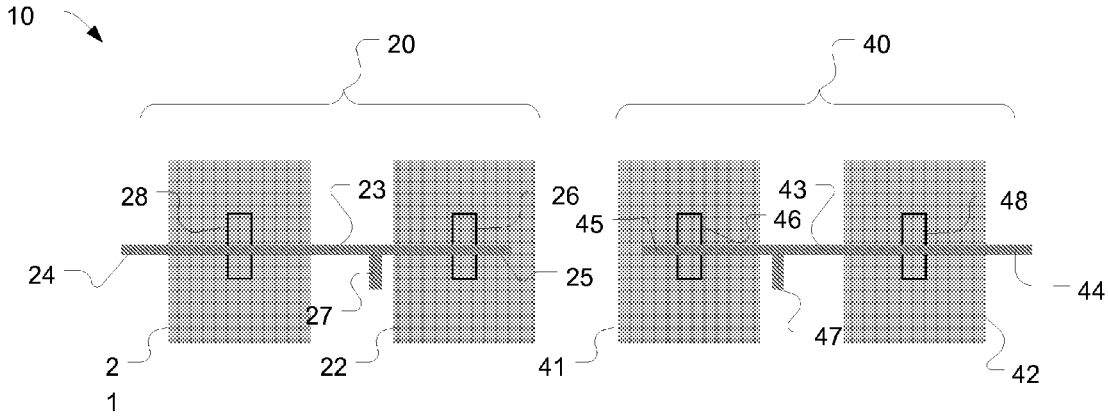
FIG. 1 is a top view schematic of the feed network of a four-element patch antenna array having two feed points, one at each end of the array in accordance with an embodiment of the present invention.

With reference to FIG. 1, dual series-fed microstrip patch antenna array 10 in accordance with an embodiment of the present invention is illustrated, comprising two pairs of antenna patch elements (first pair 20 and second pair 40), and two microstrip lines (first microstrip line 23 and second microstrip line 43)—one used to excite each pair of patch elements. The four elements are positioned in a single line (or row) as shown in FIG. 1.

First pair 20 comprises two aperture-coupled patch antenna elements—first patch element 21 and second patch element 22. First pair 20 also comprises first microstrip line 23 having first feed 24 positioned at a first end of antenna array 10. First feed 24 is used to excite first patch element 21 and second patch element 22.

The design of second pair 40 mirrors the design of first pair 20. Second pair 40 includes two aperture-coupled patch antenna elements—third patch element 41 and fourth patch element 42. Second pair 40 also includes second microstrip line 43 having second feed 44 positioned at a second end of antenna array 10. Second feed 44 is used to excite third patch element 41 and fourth patch element 42.

Second patch element 22 has microstrip stub 25, which is a short, open-circuit stub of microstrip line 23 that extends just beyond coupling slot 26. Third patch element 41 has microstrip stub 45, which is a short, open-circuit stub of microstrip line 43 that extends just beyond coupling slot 46. Microstrip stub 25 and microstrip stub 45 facilitate impedance matching in antenna array 10.

In addition, first pair 20 includes stub 27 located between first patch element 21 and second patch element 22. Stub 27 is used to achieve equal power distribution between coupling slot 28 of first patch element 21 and coupling slot 26 of second patch element 22. Similarly, second pair 40 includes stub 47 between third patch element 41 and fourth patch element 42. Stub 47 is used to achieve equal power distribution between coupling slot 46 of third patch element 41 and coupling slot 48 of fourth patch element 42. In order to account for the difference in the microstrip feed-line directions, the signals applied to each end of array 10 (at first feed 24 and second feed 44) are 180 degrees out of phase.

Figure 2:
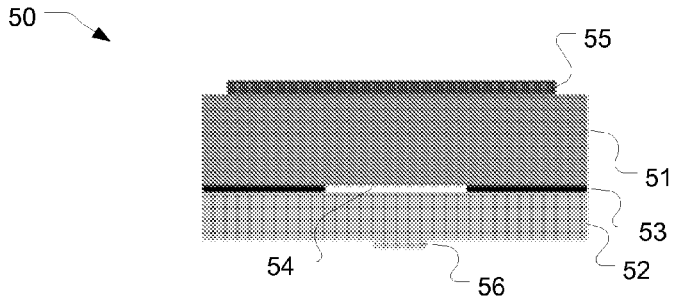
FIG. 2 is a cross-sectional view of an aperture-coupled patch antenna element in accordance with an embodiment of the present invention.

A cross-sectional view of aperture-coupled patch 50 is shown in FIG. 2. The basic design of aperture-coupled patch 50 was first presented by D. M. Pozar and typically consists of two substrates, patch substrate 51 and feed substrate 52, separated by ground plane 53 that is perturbed by coupling slot 54. "A Microstrip Antenna Aperture Coupled to a Microstrip Line," Electronics Letters, Vol. 21, pp. 49-50 (Jan. 17, 1985). Microstrip patch antenna 55 is positioned on patch substrate 51 and microstrip feed line 56 is positioned on feed substrate 52. The thickness and dielectric constant of the two substrates can be independently selected to optimize radiation characteristics (patch substrate 51) and feed network loss or size (feed substrate 52). The power from feed line 56 is coupled through ground plane slot 54 to patch antenna 55. In an exemplary embodiment of the present invention, a 20 mil Rogers 4003 ($\in_r$~3.6) feed substrate and a 125 mil Rogers 5880 ($\in_r$~2.1) patch substrate were used and the overall size of antenna array 10 was 45×115 $mm^2$.

The antenna arrays may be fabricated using standard lithography and copper etching methods. In an embodiment, copper tape may be used to bond the ground planes of adjacent sub-arrays together in order to provide continuity of the ground plane around the three-dimensional structure. Silver epoxy was utilized to ensure proper connection between ground planes and the copper tape. Proper alignment of the feed network to the patch antenna layer was achieved through the use of Teflon screws as alignment marks.

Figure 3:
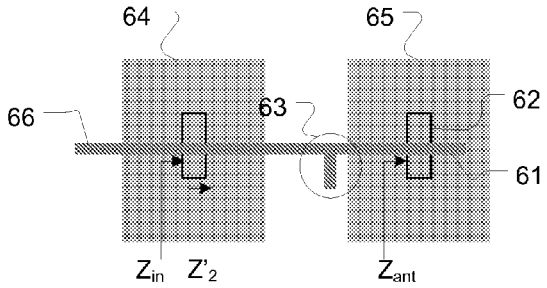
FIG. 3 is a top view schematic of the feed network of a pair of aperture-couple patch antenna elements illustrating impedance matching in accordance with an embodiment of the present invention.

Equivalent circuit models were used to optimize the feed network for return loss performance and equal power distribution. Numerical electromagnetic simulations were performed using Agilent's *Momentum*, and from these results, equivalent circuit models for individual aperture-coupled patch designs were extracted and validated. The topology used in the model, illustrated in FIG. 3, consisted of an inductor to represent the coupling slot 62, in parallel with a series RLC to emulate each patch element—first patch element 64 and second patch element 65. The circuit models were used in a network representation for each pair of elements. Along with the patch models, the network included open-circuit stub 61 terminating the inner-element feed-line, inter-element matching network 63, and input feed line 66. Matching network 63 was used to transform the input impedance of second patch 65 to $Z'_2$, such that $$Z'_2=\mathrm{conj}(Z_1) \tag{1}$$

where $Z_1$ is the impedance of first patch 64. Note that the input impedance of second patch 65 includes the effect of open-circuit stub 61, which, in part, controls the resonance of second patch 65. As a result of the impedance transformation, the input impedance at the feed point becomes $$Z_{in}=2\cdot Re(Z_1) \tag{2}$$

in accordance with the series configuration. Neglecting transmission line loss, Equation (1) ensures equal power delivery to the antenna elements. The real-valued $Z_{in}$ could be further transformed in order to maximize return loss although in this design the value was sufficiently close to 50 Ohms. Furthermore, the impedance matching approach does not, in itself, ensure equal phase excitation at the two elements; this is a requirement for broadside radiation from this pair. As shown in FIG. 1, however, a phase imbalance can be tolerated because second pair 40 restores phase symmetry about the center of four-element array 10. The phase symmetry is frequency independent and ensures a fixed broadside pattern.

Figure 4A:
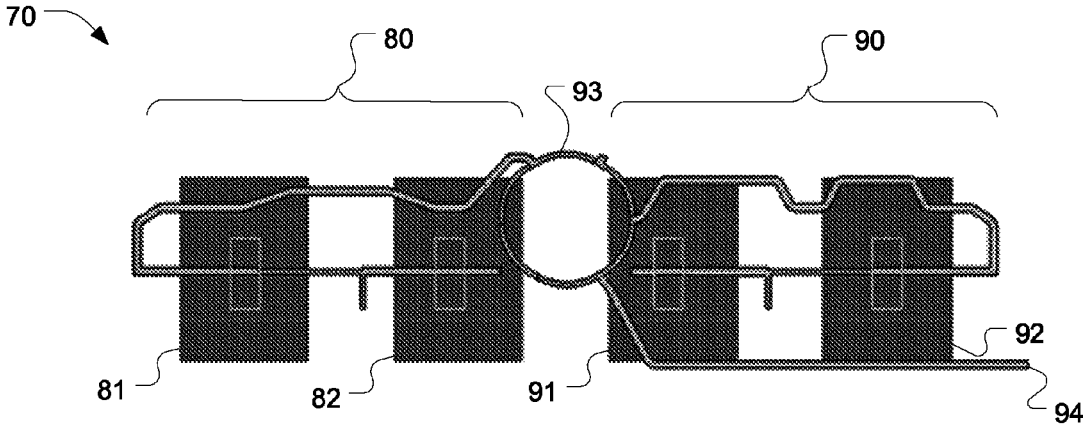
FIG. 4A is a top view schematic of the feed network of a four-element patch antenna array having a coupler to split a inbound signal into anti-phase components in accordance with an embodiment of the present invention.

With reference to FIG. 4A, microstrip patch antenna array 70 in accordance with an embodiment of the present invention is illustrated, comprising four aperture-coupled microstrip patch antenna elements 81, 82, 91, 92 positioned in a single line (or row). Each pair of patches 80, 90 employs a series-fed approach with an open-circuited stub for matching purposes as described in above and illustrated in FIG. 1.

The feeding approach uses coupler 93, which operates as a splitter/combiner. In an exemplary embodiment a hybrid rat race coupler is used, which provides a 180-degree phase offset between the two outputs of the coupler. The input signal for coupler 93, which is carried along input line 94, is equally split into anti-phase components by coupler 93, and these components are subsequently used to feed array 70 from each end. Assuming proper phase balance from coupler 93 over the desired frequency band, this configuration ensures symmetric excitation of array 70 about the central point of antenna array 70 and thus a fixed beam angle.

The coupler was designed and simulated using Agilent's *Momentum* and optimized for performance at 5 GHz. In an exemplary embodiment, the microstrip lines leading into the coupler were meandered to reduce size and to avoid adverse effects of fringing fields near the coupling slots. A comparison of the simulation results between the array fed by coupler 93, and the same array fed at each side by anti-phase signals (FIG. 1) showed negligible coupling effects from the close proximity of coupler 93 to the coupling slots for the patches.

Figure 4B:
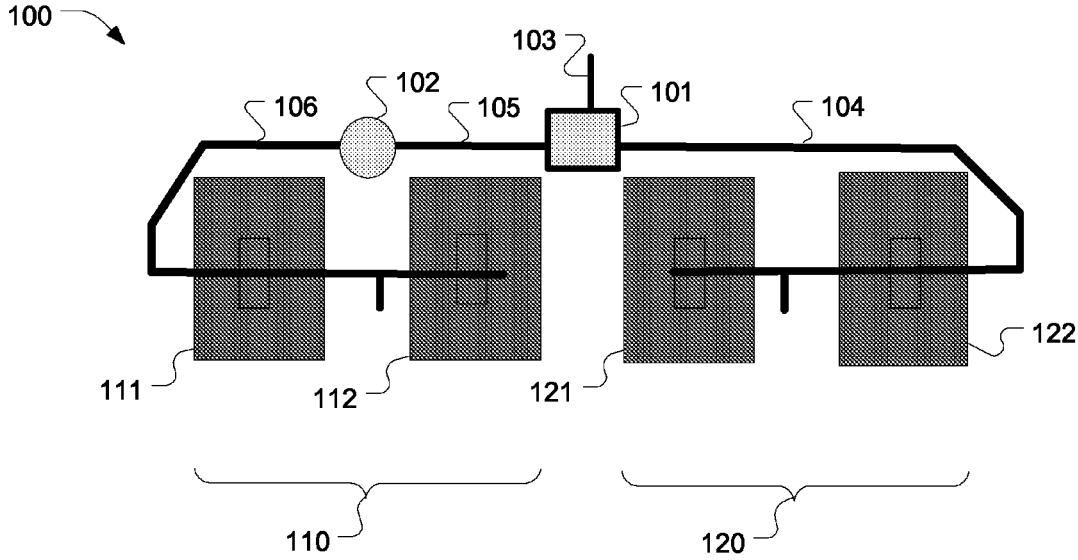
FIG. 4B is a top view schematic of the feed network of a four-element patch antenna array having a splitter to split an inbound signal into two components and a phase shifter to create anti-phase components in accordance with an embodiment of the present invention.

With reference to FIG. 4B, microstrip patch antenna array 100 in accordance with an embodiment of the present invention is illustrated, comprising four aperture-coupled microstrip patch antenna elements 111, 112, 121, 122. Each pair of patches 110, 120 employs a series-fed approach with an open-circuited stub for matching purposes as described in above and illustrated in FIG. 1. Antenna array 100 is similar to antenna array 70 shown in FIG. 4B except that antenna array 100 employs a splitter 101 and phase shifter 102 instead of a coupler.

The feeding approach of antenna array 100 uses splitter 101 to divide the incoming signal carried on input line 103 into two equal components. One signal component carried on line 104 is used to feed pair 120. The other signal component is carried on line 105 to phase shifter 102 where it is phase-shifted 180 degrees. This phase-shifted signal is then carried on line 106 and used to feed pair 110. The splitter and phase shifter combination thereby creates equally split anti-phase components of the incoming signal, which are then used to feed array 100 from each end.

Figure 5A:
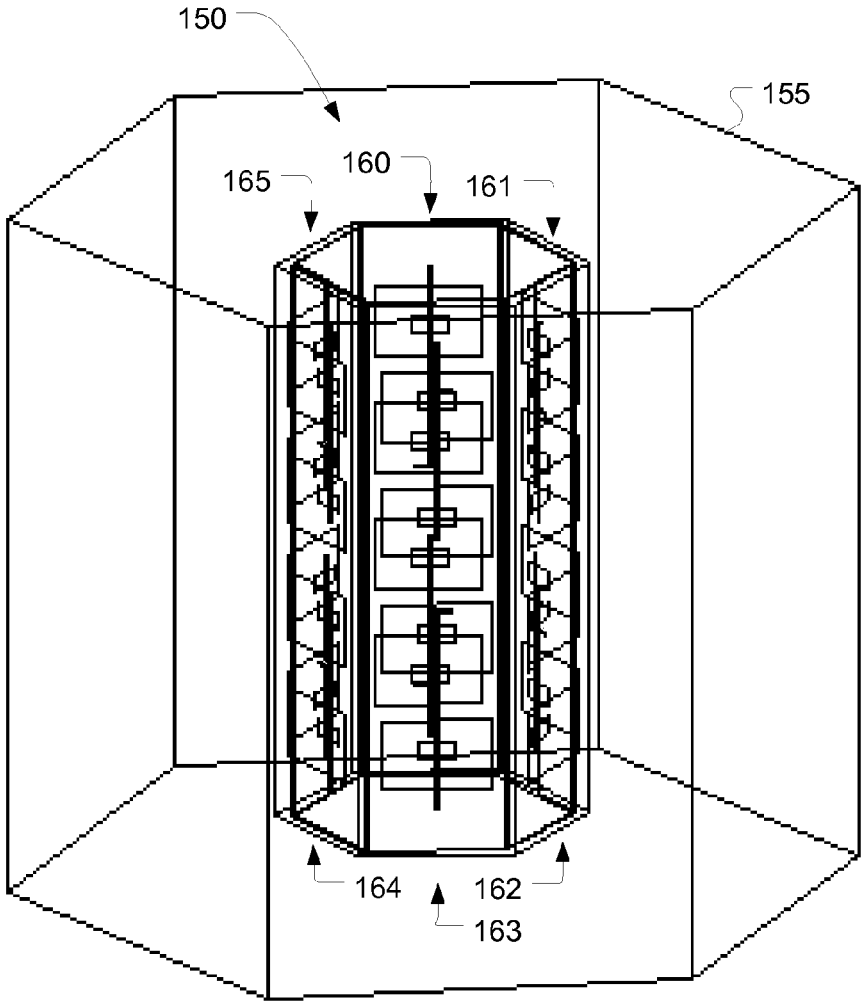
FIG. 5A is an isometric diagram of the omni-directional antenna in a hexagonal configuration as simulated in HFSS in accordance with an embodiment of the present invention.
Figure 5B:
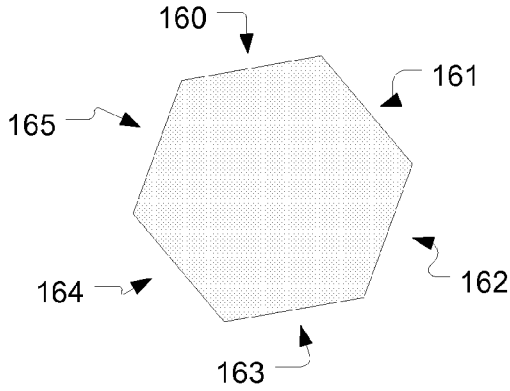
FIG. 5B is a diagram of the top view of the omni-directional antenna in a hexagonal configuration in accordance with an embodiment of the present invention.

With reference to FIG. 5, omni-directional antenna 150 in accordance with an embodiment of the present invention is illustrated, comprising a plurality of sub-arrays 160, 161, 162, 163, 164, 165, 166 arranged in a manner such that each sub-array 160, 161, 162, 163, 164, 165, 166 is positioned on the face of a hexagonal prism. FIG. 5A is a diagram of an isometric view of omni-directional antenna 150 as rendered by Ansoft's HFSS. A diagram illustrating the top view of omni-directional antenna 150 is shown in FIG. 5B. Each sub-arrays 160, 161, 162, 163, 164, 165, 166 comprises an array of antenna elements and may include the array embodiments described above and illustrated in FIGS. 1 and 4. A hexagonal shape is used for illustrative purposes. Any three-dimensional geometrical shape conducive to creating a multi-directional coverage is anticipated by the present invention including, but not limited to, cylinders, cones, and multi-sided prisms, such as hexagonal prisms, triangular prisms, rectangular prism, pentagonal prisms, octagonal prism, and a decagonal prism.

In the exemplary embodiment shown in FIG. 5, the array illustrated in FIG. 4A was used for each of six sub-arrays placed in a hexagonal prism shape.

Figure 6:
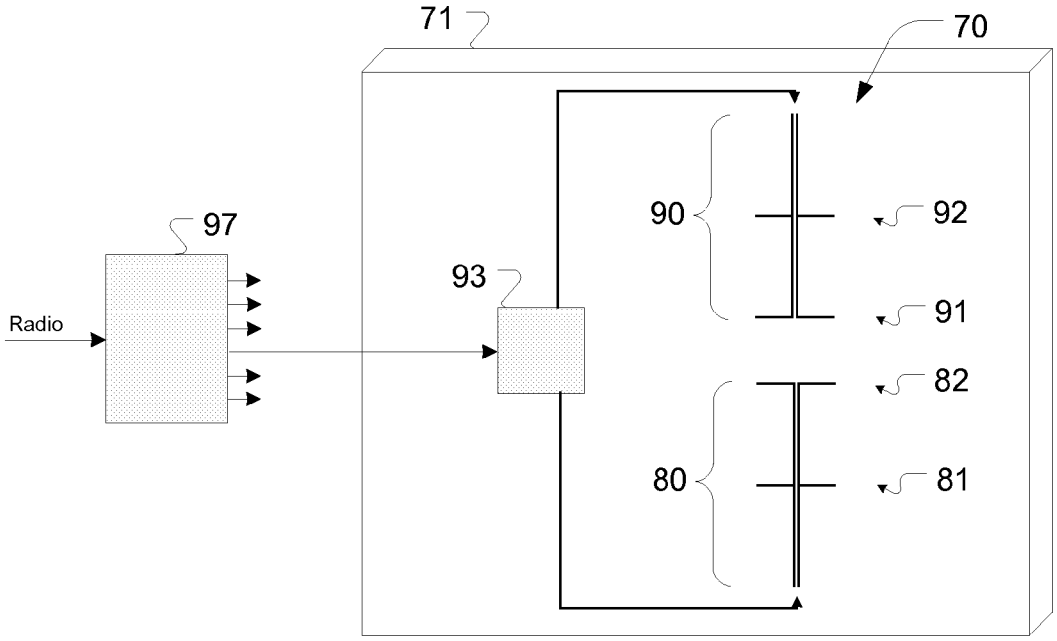
FIG. 6 is a diagram of a four-element patch antenna array having a coupler fabricated on a planar PCB substrate receiving an input signal from a power divider in accordance with an embodiment of the present invention.

FIG. 6 shows a schematic of antenna array 70 (also illustrated in FIG. 4A) fabricated on planar PCB substrate 71. A radio signal is received by power divider 97. Power divider 97 is illustrated in FIG. 6 as a six-way power divider; however, any number of power divisions is contemplated according to the number of array used to create the omni-directional antenna. Each divided signal is routed via a transmission line to one of the sub-arrays in the omni-direction antenna. For illustrative purposes, FIG. 6 only shows a single transmission line coupled to one of the sub-arrays. However, the remaining power divider outputs would each be connected to each remaining sub-array.

The three-dimensional structure illustrated in FIG. 5 was simulated in Ansoft's *HFSS*. Hexagonal prism 155 located around the array structure is the radiation boundary used in the simulations.

Figure 7:
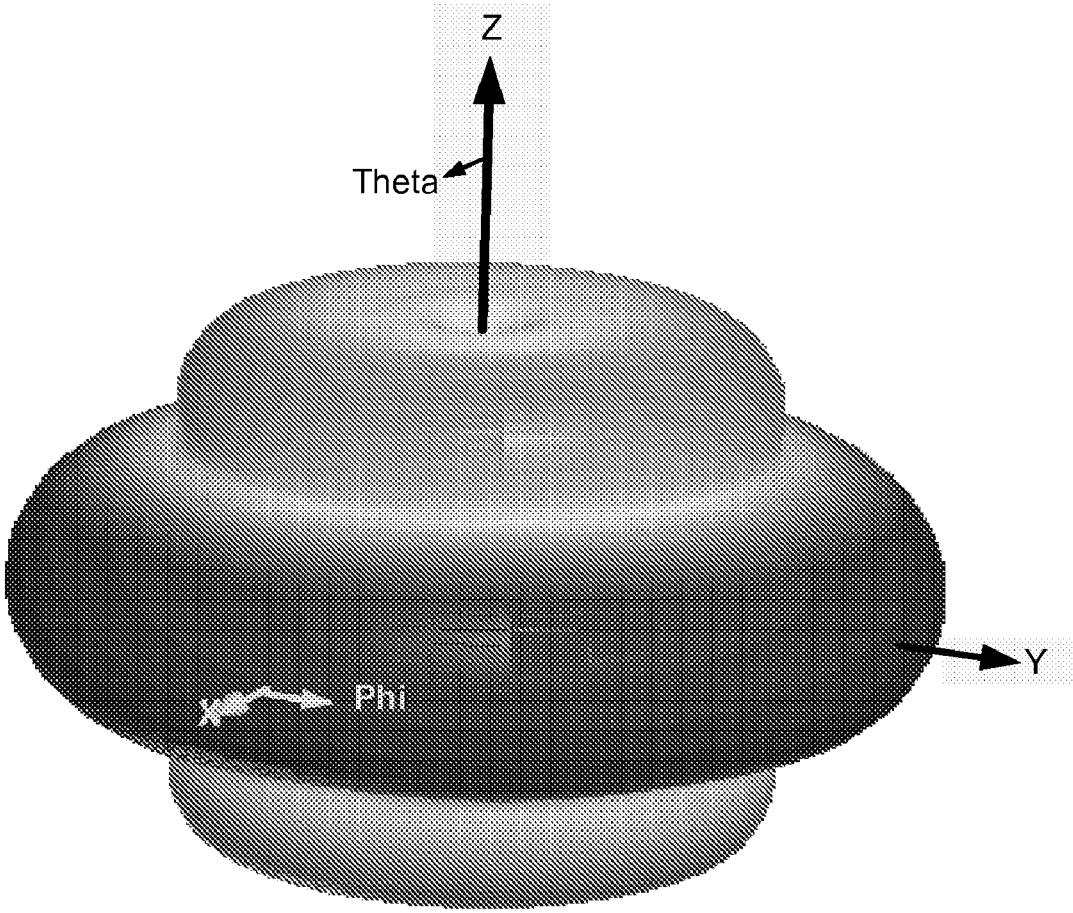
FIG. 7 is a three-dimensional polar plot of the omni-directional antenna in a hexagonal configuration simulated in HFSS in accordance with an embodiment of the present invention.

The three-dimensional plot of the simulated radiation pattern, given in FIG. 7, illustrates superior omni-directional coverage. Although the antenna is not perfectly cylindrical (rather, it is hexagonal) the variation in gain over azimuth was only approximately +/−0.5 dB. The simulated maximum gain was ~6 dB at 5 GHz.

Figure 8:
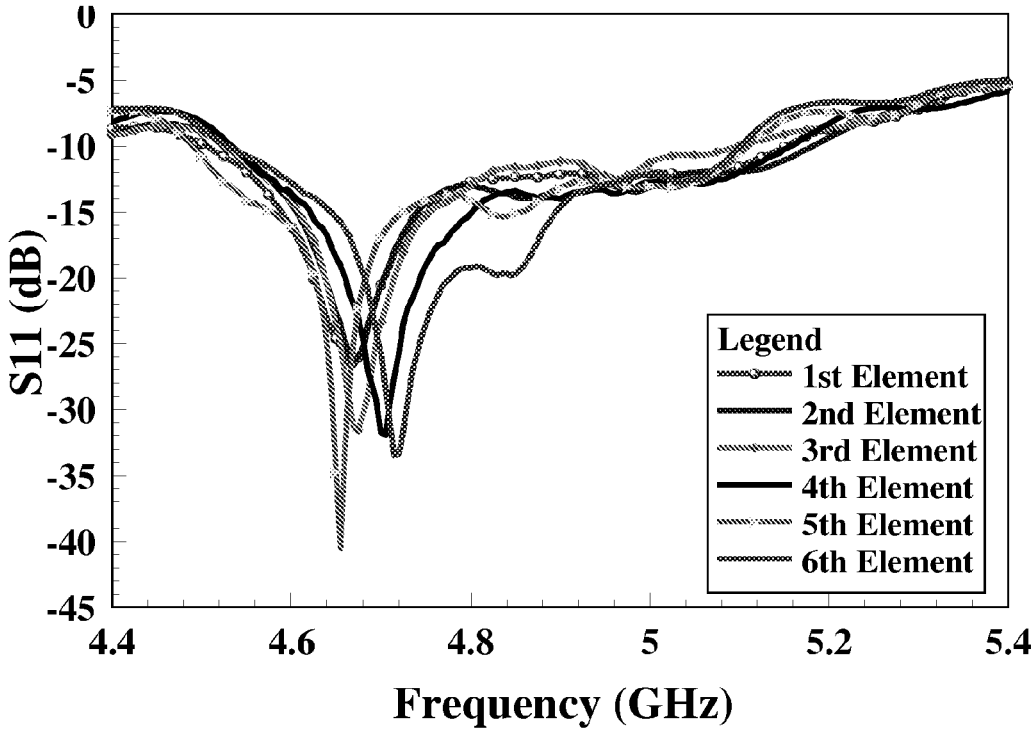
FIG. 8 is a graph showing the measured $S_{11}$ (the amount of power reflected from the antenna) for each of six sub-arrays of the omni-directional antenna in a hexagonal configuration in accordance with an embodiment of the present invention.

Six sub-arrays were fabricated and the return loss of each was measured to verify reasonable uniformity in the prototype fabrication process. As shown in FIG. 8, the measured $S_{11}$ for all six arrays are in relatively close agreement. The variation that is observed may be due to using an inconsistent amount of non-conductive epoxy in bonding each antenna layer and feed layer together.

To assemble the three-dimensional structure, six fabricated sub-array feed layers were first mounted on a hexagonal Teflon apparatus. The Teflon holder was designed to provide structural support for the sub-arrays while minimizing electromagnetic interaction with the feed layers that face toward the center of the holder. As described above, copper tape and conductive silver epoxy were used to form a continuous ground plane between the sub-arrays. Continuity of the ground layer was essential in preventing the occurrence of nulls in the azimuth radiation pattern. The six sub-arrays were fed using an 8-way 0-degree coaxial coupler (Mini Circuits P/N ZB8PD-6.4) with two ports terminated in a matched load.

Figure 9:
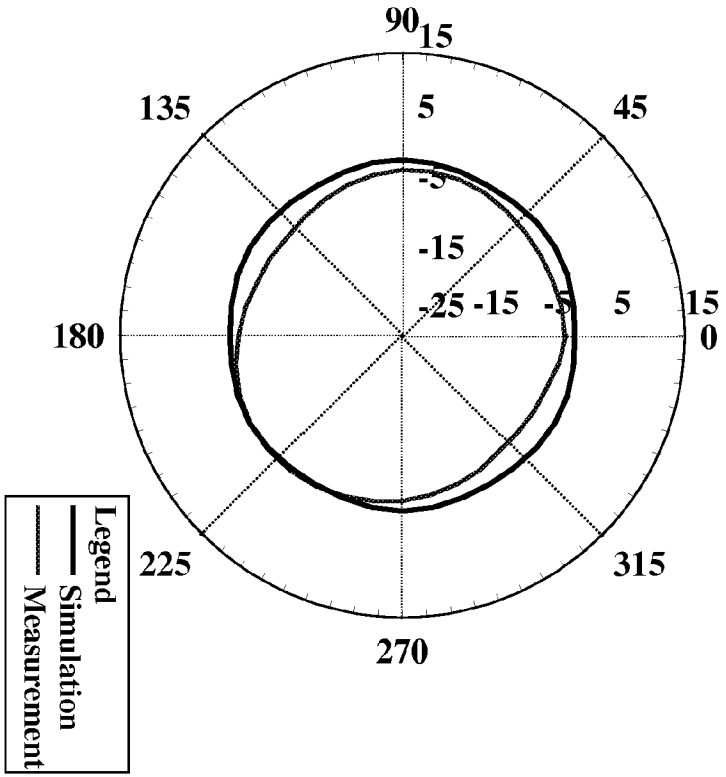
FIG. 9 is a plot of the azimuth radiation pattern at theta=90 degrees (broadside) for the omni-directional antenna in a hexagonal configuration in accordance with an embodiment of the present invention.
Figure 10:
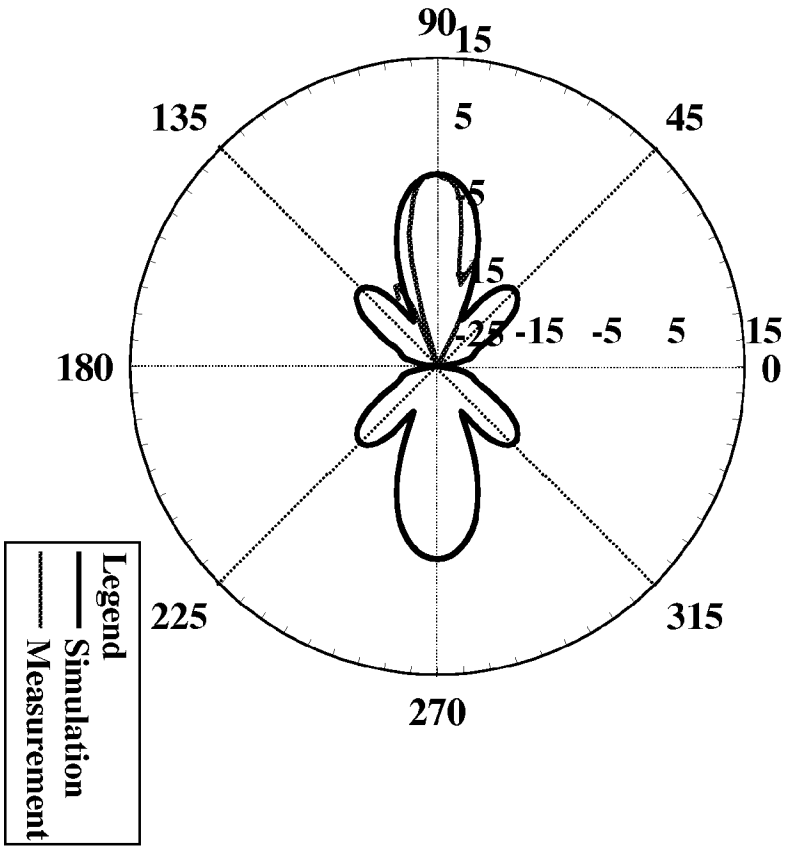
FIG. 10 is a plot of the elevation radiation pattern for the omni-directional antenna in a hexagonal configuration in accordance with an embodiment of the present invention.

Comparisons between measured and simulated radiation patterns are given in FIGS. 9 and 10. The measured azimuth radiation pattern at 5 GHz agrees closely the simulated results from HFSS (FIG. 9), and demonstrates a variation of ~+/−1.5 dB over the 360-degree span. Although the antenna measurement system that was used did not readily enable a full elevation cut to be measured, the data taken between +/−45 degrees is in good agreement with the HFSS simulation results (FIG. 10). The simulated and measured 3 dB beam widths are 35 and 30 degrees, respectively.

Figure 11:
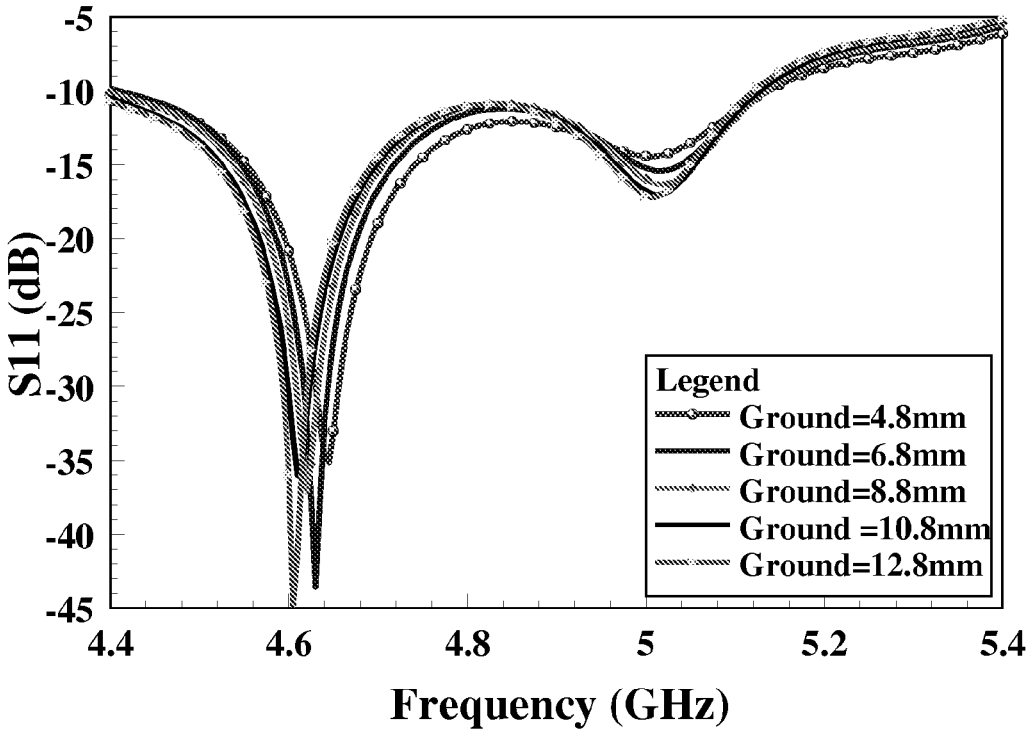
FIG. 11 is a graph showing the return loss for different sizes of ground planes for the single sub-array in accordance with an embodiment of the present invention.
Figure 12:
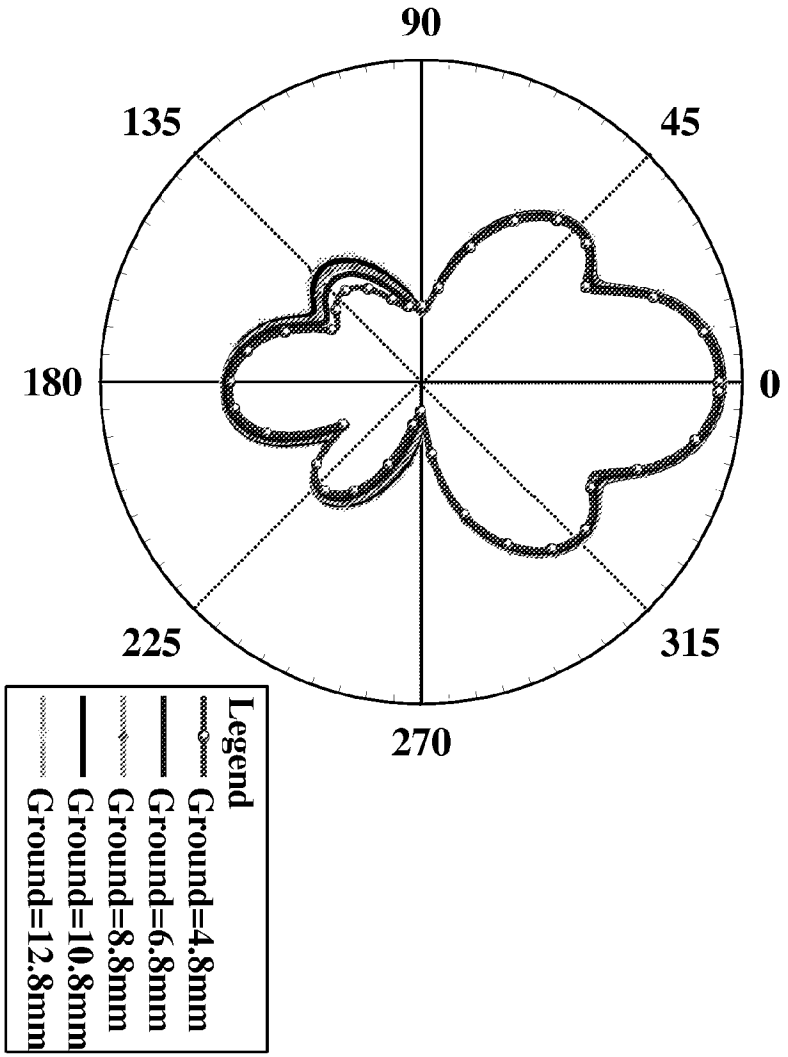
FIG. 12 is a plot of the elevation radiation pattern at phi=0 degrees (broadside) for different sizes of ground planes for a single sub-array in accordance with an embodiment of the present invention.

Additional HFSS simulations were performed in order to investigate the impact of increasing the size of the ground plane, and thus the substrate surrounding the patch elements. The fabricated sub-arrays had 10 mm of ground/substrate extending beyond the edges of patches, partly to accommodate the Teflon alignment screws. $S_{11}$ results for different ground plane extensions for the single sub-arrays showed that minimal performance variation was introduced for ground extensions ranging form 4.8 to 12.8 mm (FIG. 11). The impact of ground plane size on the sub-array radiation pattern was likewise relatively small, with the most noticeable differences occurring at the back-lobe direction (FIG. 12). The sub-array widths can be reduced in order to shrink the diameter of the hexagonal structure, and further improve the uniformity of the omni-directional coverage.

Figure 13A:
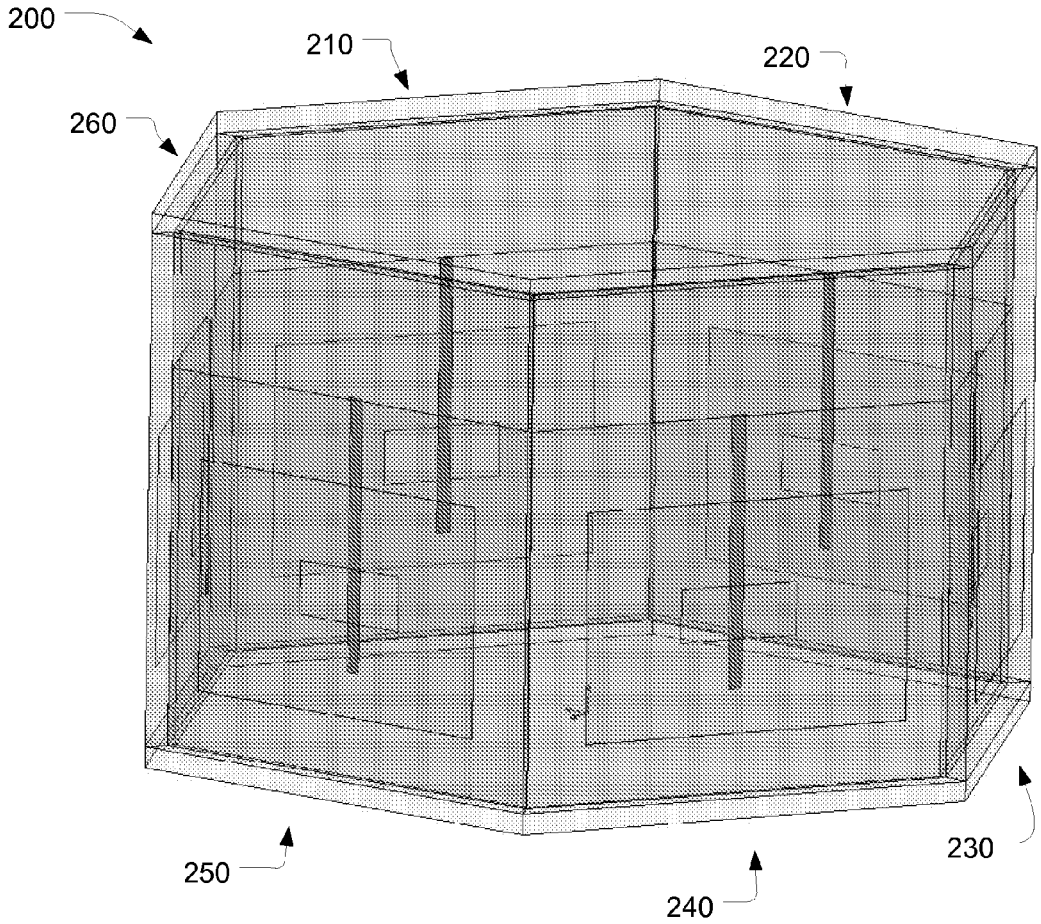
FIG. 13A is an isometric diagram of the omni-directional antenna in a hexagonal configuration with a single patch antenna positioned on each face of the hexagonal prism as simulated in HFSS in accordance with an embodiment of the present invention.
Figure 13B:
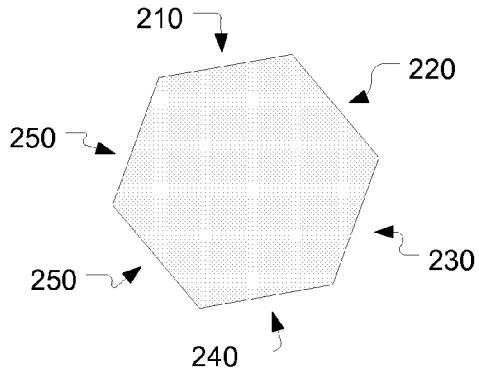
FIG. 13B is a diagram of the top view of the omni-directional antenna in a hexagonal configuration in accordance with an embodiment of the present invention.

With reference to FIG. 13A, omni-directional antenna 200 in accordance with an embodiment of the present invention is illustrated, comprising a plurality of patch antennas elements 210, 220, 230, 240, 250, 260 arranged in a manner such that each patch antenna element 210, 220, 230, 240, 250, 260 is positioned on the face of a hexagonal prism. FIG. 13A is diagram of a isometric view of omni-directional antenna 200 as rendered by Ansoft's HFSS. A diagram illustrating the top view of omni-directional antenna 200 is shown in FIG. 13B. Each patch antenna element 210, 220, 230, 240, 250, 260 having an aperture-coupled patch antenna.

Figure 14A:
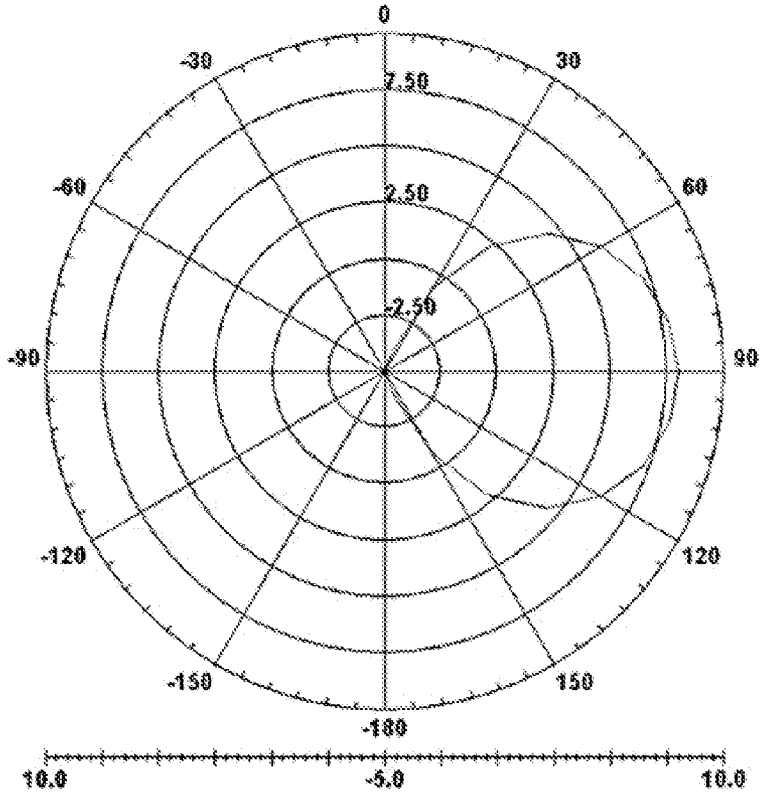
FIG. 14A is a plot of the simulated radiation pattern for the omni-directional antenna of FIG. 13 with a single element excited in accordance with an embodiment of the present invention.
Figure 14B:
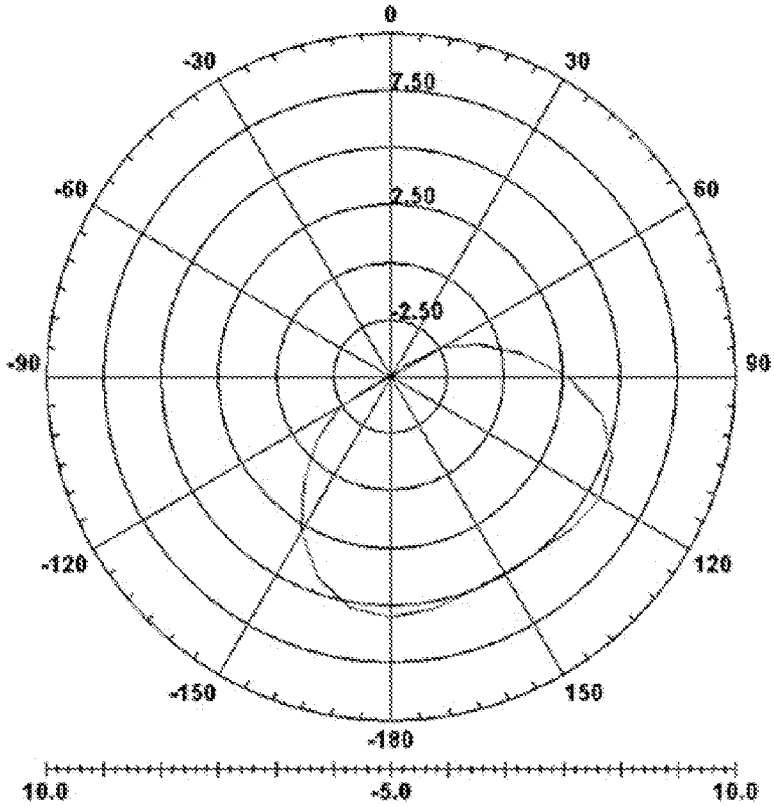
FIG. 14B is a plot of the simulated radiation pattern for the omni-directional antenna of FIG. 13 with a three neighboring elements excited in accordance with an embodiment of the present invention.
Figure 14C:
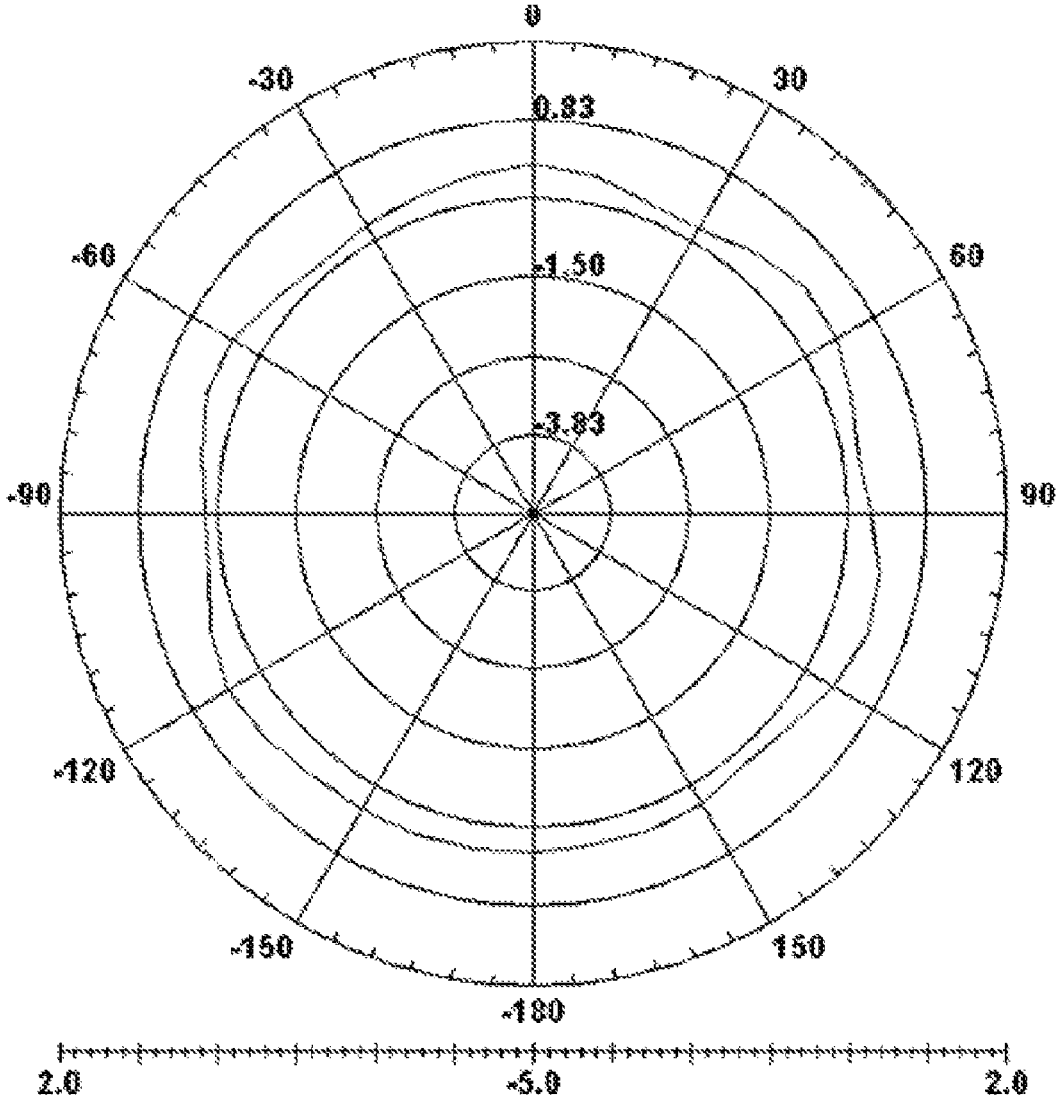
FIG. 14C is a plot of the simulated radiation pattern for the omni-directional antenna of FIG. 13 with a all six elements excited in accordance with an embodiment of the present invention.

Radiation patterns from simulations of this designed performed using HFSS are shown in FIGS. 14A-14C. FIG. 14A shows a radiation pattern of omni-directional antenna 200 with excitations of a single element, such as element 230. FIG. 14B shows the radiation pattern when three neighboring elements, such as element 230, element 240, and element 250 are excited. FIG. 14C shows the radiation pattern when all six elements 210,220,230,240,250,260 are excited. The results indicate that, when all six elements are excited, the variation in directivity versus azimuth angle is ~+/−0.35 dB.

Figure 15:
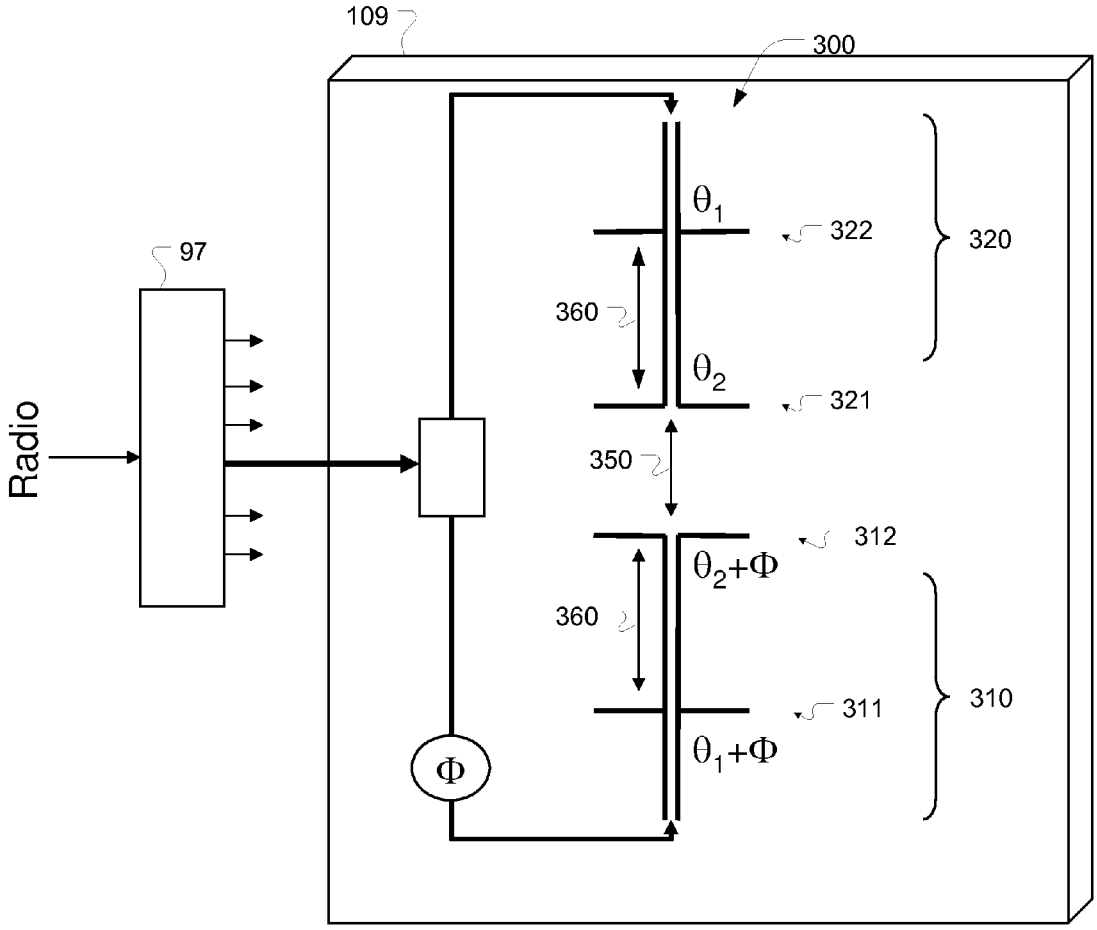
FIG. 15 is a diagram of a four-element patch antenna array fabricated on a planar PCB substrate receiving an input signal from a power divider illustrating pair spacing and element spacing in accordance with an embodiment of the present invention.

Analyses using ideal point radiators were performed in order to study the impact of design parameters including pair spacing and element spacing. The parameters involved in pair spacing and element spacing are illustrated in FIG. 15. For analysis purposes, the design assumes six sub-arrays 300 spaced around a hexagonal body (as was illustrated in FIGS. 5A and 5B). Each sub-array 300 is comprised of two pairs of two patch antenna elements (first pair 310 and second pair 320). First pair 310 comprises first patch antenna element 311 and second patch antenna element 312. Second pair 320 comprises third patch antenna element 321 and fourth patch antenna element 322.

Figure 16A:
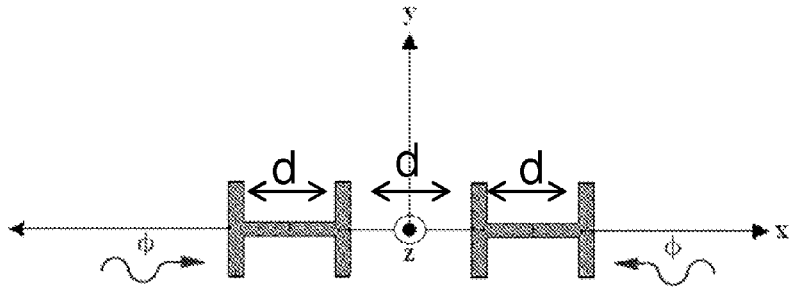
FIG. 16A is a graph showing the top view and side view of the patch elements with equal element spacing and pair spacing in accordance with an embodiment of the present invention.
Figure 16B:
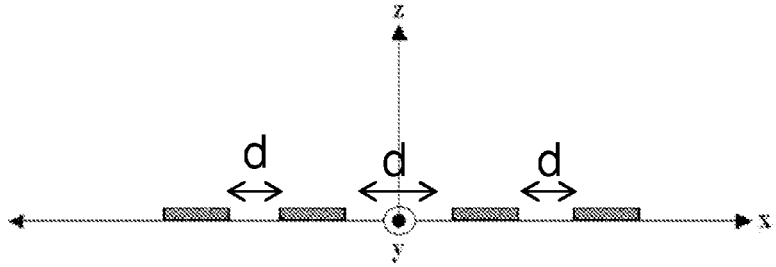
FIG. 16B is a diagram illustrating the pattern variation for the element spacing and pair spacing as shown in FIG. 16A in accordance with an embodiment of the present invention.
Figure 16B:
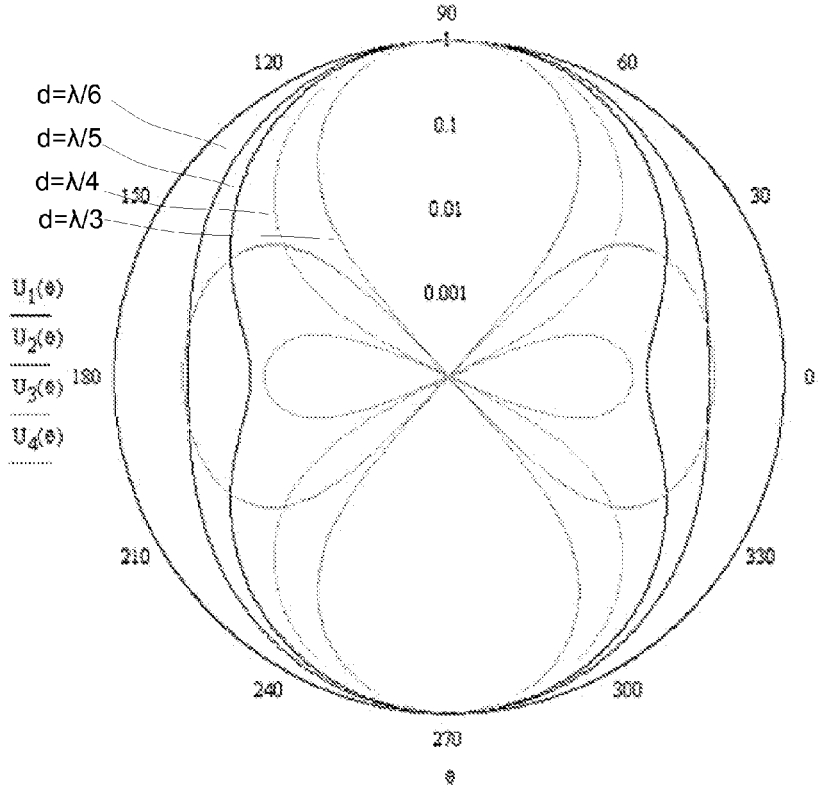

Pair spacing 350 is the distance between first pair 310 and second pair 320. Element spacing 360 is the distance between two patch antenna elements of a pair, such as the distance between first element 311 and second element 312. The simulated patterns assuming uniform spacing (pair spacing 350 equal to element spacing 360), perfect phase balance, and an inner element amplitude that is 70% of the outer element amplitude, are shown in FIGS. 16A and 16B. In this example, a side lobe begins to form at ~$\lambda/4$ spacing. The difference in the amplitudes between the inner element (second element 312 and third element 321) and the outer elements (first element 311 and fourth element 322) was included due to the series nature of the feed. The choice of 70% is arbitrary and only used for demonstration purposes.

Figure 17A:
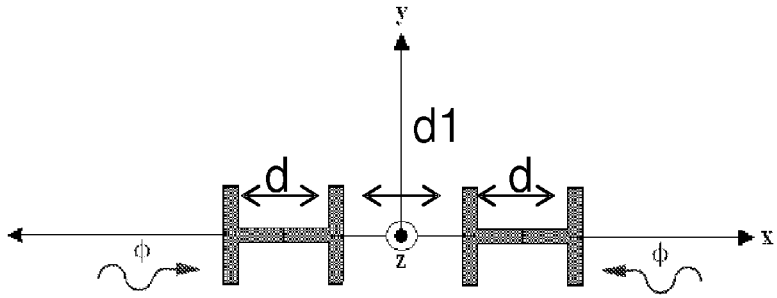
FIG. 17A is a graph showing the top view and side view of the patch elements with a variation in pair spacing in accordance with an embodiment of the present invention.
Figure 17B:
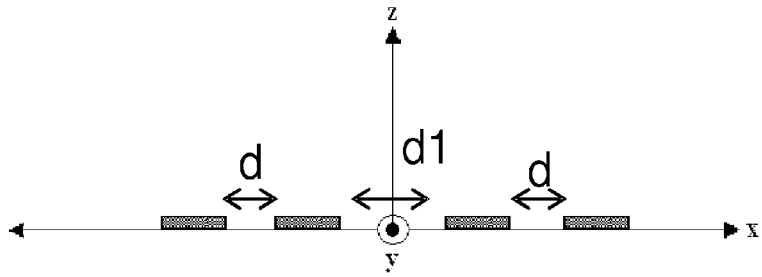
FIG. 17B is a diagram illustrating the pattern variation for varying pair spacing as shown in FIG. 17A in accordance with an embodiment of the present invention.
Figure 17B:
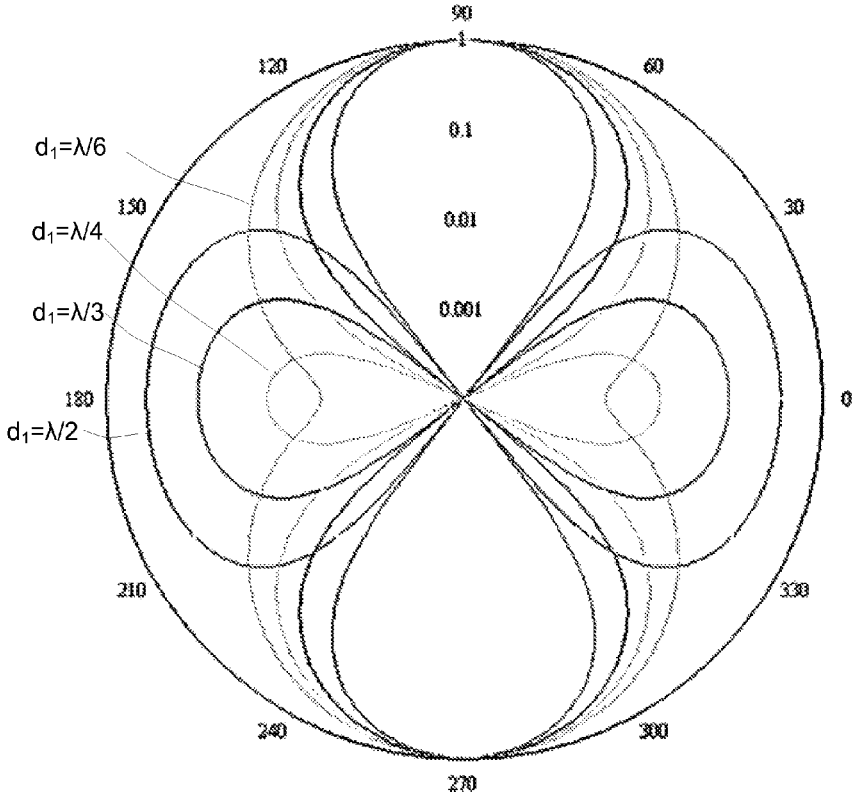

A second example, looking at the variation of pair spacing $d_1$, with a constant sub-element spacing of $\lambda/4$, is shown in FIGS. 17A and 17B. Once again, the inner sub-element amplitude is assumed to be 70% of the outer sub-element amplitude. These results show that pair spacing 350 can be reduced to minimize side lobes, thereby providing some flexibility after pair design is optimized for impedance match, etc.

As a final example, FIGS. 18A and 18B show the pattern with variations in the relative phase on the right side (or top) feed. As before, the inner sub-element amplitude is 70% of the outer sub-element amplitude and the sub-element and pair spacings are $\lambda/4$. The results show that a phase difference of 15 degrees results in a pattern shift of ~5 degrees, thus indicating that the performance is relatively insensitive to feed phase error.

Figure 19:
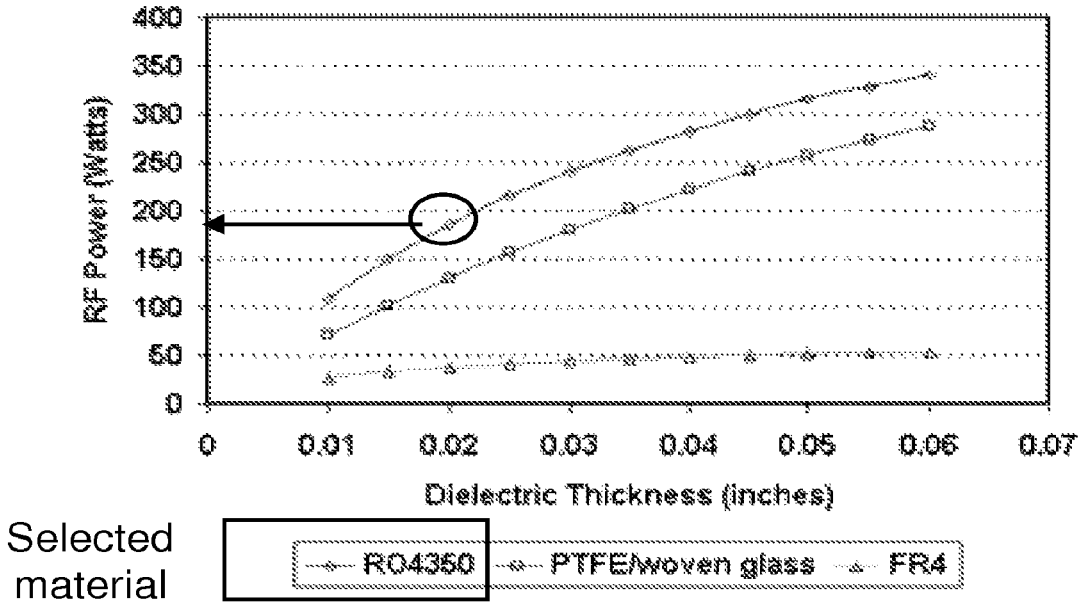
FIG. 19 is a graph illustrating the power rating characteristics of substrate materials used in fabricating the antenna in accordance with an embodiment of the present invention.

Power handling capacity is usually associated with temperature rise and maintaining the operating temperature below the rated value for the given material. The main concern is that the traces will delaminate. For the materials selected for an exemplary embodiment of this invention (Rogers 4003 and 4350) maintaining the continuous operating temperature below 125° C. is recommended, which means that the temperature rise should be less than 100° C. (assuming 25° C. ambient temperature). The minimum substrate thickness planned is 20 mils, and according to FIG. 19, at 2 GHz~180 W is required to yield 100 degrees C. temperature rise. A conservative estimate is that the 200 W total power will be split between 6-8 elements, such that the power handling capability will be considerably more than adequate for the antenna elements and feed network traces.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A microstrip patch array antenna comprising:

a first aperture-coupled patch antenna element;

a second aperture-coupled patch antenna element positioned in a single row arrangement with the first antenna element; and a feed line coupled to the first antenna element and the second antenna element such that the first and second antenna elements are connected in series, the feed line having a first open-circuit stub positioned between the first antenna element and the second antenna element and a second open-circuit stub positioned on the second antenna element.

2. The microstrip patch array antenna of claim 1, further comprising:

a third aperture-coupled patch antenna element positioned in a single row arrangement with the first antenna element and the second antenna element;

a fourth aperture-coupled patch antenna element positioned in a single row arrangement with the first antenna element, the second antenna element, and the third antenna element; and a second feed line coupled to the third antenna element and the fourth antenna element such that the third and fourth antenna elements are connected in series, the second feed line having a third open-circuit stub positioned between the third antenna element and the fourth antenna element and a fourth open-circuit stub positioned on the third antenna element.

3. The microstrip patch array antenna of claim 2, further comprising:

a coupler having a first output coupled to the feed line and a second output coupled to the second feed line.

4. The microstrip patch array antenna of claim 2, further comprising:

a phase shifter having an input and having an output coupled to the second feed line; and a two-way power divider having a first output coupled to the feed line and a second output coupled to the input port of the phase shifter.

5. The microstrip patch array antenna of claim 2, further comprising:

circuitry for dividing an input signal into a first component signal and a second component signal and phase offsetting the first component signal, the circuitry having a first output coupled to the feed line to transmit the first component signal and a second output coupled to the second feed line to transmit the second component signal.

6. The microstrip patch array antenna of claim 2, further comprising:

circuitry having a first output coupled to the feed line to transmit a first component signal and a second output coupled to the second feed line to transmit a second component signal.

7. A method of providing symmetrical excitation of a microstrip patch array antenna about a central point, comprising:

providing a microstrip patch array antenna comprising:

a first aperture-coupled patch antenna element, a second aperture-coupled patch antenna element positioned in a single row arrangement with the first antenna element, a first feed line coupled to the first antenna element and the second antenna element such that the first and second antenna elements are connected in series, the first feed line having a first open-circuit stub positioned between the first antenna element and the second antenna element and a second open-circuit stub positioned on the second antenna element, a third aperture-coupled patch antenna element positioned in a single row arrangement with the first antenna element and the second antenna element, a fourth aperture-coupled patch antenna element positioned in a single row arrangement with the first antenna element, the second antenna element, and the third antenna element, and a second feed line coupled to the third antenna element and the fourth antenna element such that the third and fourth antenna elements are connected in series, the second feed line having a third open-circuit stub positioned between the third antenna element and the fourth antenna element and a fourth open-circuit stub positioned on the third antenna element;

applying a first signal to the first feed line; and applying a second signal to the second feed line.

8. The method of claim 7, wherein the first signal and the second signal are about 180 degrees out of phase.

9. The method of claim 7, wherein the microstrip patch array antenna further comprises:

a coupler having a first output coupled to the first feed line and a second output coupled to the second feed line.

10. The method of claim 7, wherein the microstrip patch array antenna further comprises:

a phase shifter having an input and having an output coupled to the second feed line; and a two-way power divider having a first output coupled to the first feed line and a second output coupled to the input of the phase shifter.

11. The method of claim 7, wherein the microstrip patch array antenna further comprises:

circuitry for dividing an input signal into a first component signal and a second component signal and phase offsetting the first component signal, the circuitry having a first output coupled to the first feed line to transmit the first component signal and a second output coupled to the second feed line to transmit the second component signal.

12. The microstrip patch array antenna of claim 7, further comprising:

circuitry having a first output coupled to the first feed line to transmit a first component signal and a second output coupled to the second feed line to transmit a second component signal.

13. An antenna comprising:

at least two sub-arrays of microstrip patch antennas arranged such that each sub-array forms a single face of a multi-sided three-dimensional geometric shape, each of the at least two sub-arrays comprising:

a first aperture-coupled patch antenna element, a second aperture-coupled patch antenna element positioned in a single row arrangement with the first antenna element, a first feed line coupled to the first antenna element and the second antenna element such that the first and second antenna elements are connected in series, the first feed line having a first open-circuit stub positioned between the first antenna element and the second antenna element and a second open-circuit stub positioned on the second antenna element, a third aperture-coupled patch antenna element positioned in a single row arrangement with the first antenna element and the second antenna element, a fourth aperture-coupled patch antenna element positioned in a single row arrangement with the first antenna element, the second antenna element, and the third antenna element, and a second feed line coupled to the third antenna element and the fourth antenna element such that the third and fourth antenna elements are connected in series, the second feed line having a third open-circuit stub positioned between the third antenna element and the fourth antenna element and a fourth open-circuit stub positioned on the third antenna element.

14. The antenna of claim 13, wherein each of the plurality of sub-arrays further comprises:

a coupler having a first output coupled to the first feed line and a second output coupled to the second feed line.

15. The antenna of claim 14, further comprising:

a multi-way power divider coupled to each of the couplers of each of the sub-arrays.

16. The antenna of claim 13, wherein each of the plurality of sub-arrays further comprises:

a phase shifter having an input and having an output coupled to the second feed line; and a two-way power divider having a first output coupled to the first feed line and a second output coupled to the input of the phase shifter.

17. The antenna of claim 16, further comprising:

a multi-way power divider coupled to each of the two-way power dividers of each of the sub-arrays.

18. The antenna of claim 17, wherein each antenna element further comprises a ground layer positioned in between the feed substrate and the patch substrate, the ground layer being continuous between the sub-arrays.

19. The antenna of claim 13, wherein each of the plurality of sub-arrays further comprises:

splitting and offsetting circuitry for dividing an input signal into a first component signal and a second component signal and phase offsetting the first component signal, the circuitry having a first output coupled to the first feed line to transmit the first component signal and a second output coupled to the second feed line to transmit the second component signal.

20. The antenna of claim 19, further comprising:

a multi-way power divider coupled to each of the splitting and offsetting circuitry of each of the sub-arrays.

21. The antenna of claim 20, wherein the ground layer is formed from conductive silver epoxy and copper tape.

22. The microstrip patch array antenna of claim 13, further comprising:

splitting and offsetting circuitry having a first output coupled to the first feed line to transmit a first component signal and a second output coupled to the second feed line to transmit a second component signal.

23. The antenna of claim 22, further comprising:

a multi-way power divider coupled to each of the splitting and offsetting circuitry of each of the sub-arrays.

24. The antenna of claim 13, wherein each antenna element is comprised of a feed substrate and a patch substrate and wherein each of the feed substrates faces toward the inside of the multi-sided three-dimensional geometric shape.

25. The antenna of claim 13, further comprising:

a reflector positioned within the multi-sided three-dimensional geometric shape to preserve backside radiation.

26. An antenna comprising:

a first microstrip patch antenna element having a coupling slot and positioned such that the first antenna element forms a first face of a multi-sided three-dimensional geometric shape;

a first feed line forming an open-circuit stub on the first antenna element;

a second microstrip patch antenna element having a coupling slot and positioned such that the second antenna element forms a second face of the multi-sided three-dimensional geometric shape; and a second feed line forming an open-circuit stub on the second antenna element.

27. The antenna of claim 26, further comprising:

A multi-way power divider having a first output coupled to the first feed line and a second output coupled to the second feed line.

28. The antenna of claim 26, wherein each antenna element is comprised of a feed substrate and a patch substrate and wherein each of the feed substrates faces toward the inside of the multi-sided three-dimensional geometric shape.

29. The antenna of claim 28, wherein each antenna element further comprises a ground layer positioned in between the feed substrate and the patch substrate, the ground layer being continuous between the sub-arrays.

30. The antenna of claim 29, wherein the ground layer is formed from conductive silver epoxy and copper tape.

31. The antenna of claim 26, further comprising:

a reflector positioned within the multi-sided three-dimensional geometric shape to preserve backside radiation.

* * * * *